US006534170B2

(12) United States Patent
Mochida et al.

(10) Patent No.: US 6,534,170 B2
(45) Date of Patent: Mar. 18, 2003

(54) DIAMOND-COATED SLIDING PART

(75) Inventors: Yasushi Mochida, Itami (JP); Takao Nishioka, Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/725,854

(22) Filed: Nov. 30, 2000

(65) Prior Publication Data

US 2001/0003278 A1 Jun. 14, 2001

(30) Foreign Application Priority Data

Dec. 1, 1999 (JP) ..... 11-342205
Dec. 1, 1999 (JP) ..... 11-342206

(51) Int. Cl.[7] ..... F01L 1/16; F01L 1/20

(52) U.S. Cl. ..... 428/336; 428/408; 428/698; 428/141; 428/174; 123/90.14

(58) Field of Search ..... 428/141, 174, 428/408, 446, 698, 336; 123/90.14

(56) References Cited

U.S. PATENT DOCUMENTS 4,974,498 A * 12/1990 Lemelson ..... 92/223
5,040,501 A * 8/1991 Lemelson ..... 123/188 A
6,237,441 B1 * 5/2001 Nishioka et al. ..... 74/569

FOREIGN PATENT DOCUMENTS

| | | |
|---|---|---|
| EP | 0 379 220 | 7/1990 |
| EP | 0 435 272 | 7/1991 |
| EP | 0 577 877 | 1/1994 |
| EP | 0 953 733 | 11/1999 |
| JP | 6-137406 | 5/1994 |
| JP | 6-294307 | 10/1994 |

* cited by examiner

*Primary Examiner*—Archene Turner
(74) *Attorney, Agent, or Firm*—McDermott, Will & Emery

(57) ABSTRACT

Provided is a diamond-coated sliding part that is light, has excellent abrasion resistance, that prevents abrasion of the material of an opposite member, and that is effective in reducing power loss. This sliding part is especially useful as an adjusting shim for the valve train mechanism of an internal combustion engine such as an automobile engine in which the base material is silicon nitride or sialon and this base material surface is coated with a diamond coating layer. By performing finish processing on only a small part of peaks of diamond particles protruding from the surface of the diamond coating layer to reduce the height of the protrusions, or by controlling film forming conditions, etc., the profile bearing length ratio ($t_p$) at a cutting level of 0.1 $\mu$m for the sliding surface of the diamond coating layer is made 60% or greater.

7 Claims, 2 Drawing Sheets

DIAMOND-COATED SLIDING PART

BACKGROUND OF THE INVENTION

1. Field of the Invention

The present invention relates to a sliding part such as an adjusting shim used for a valve train mechanism of an internal combustion engine.

2. Description of the Related Art

In recent years, in the automotive field, from the perspective of saving energy, improvement in fuel consumption has become urgent. As a measure to achieve this, in parallel with lighter vehicle weight and improved engine heat efficiency, the reduction of power loss for engines and the like has become an important task. In particular, among the types of engine power loss, as a measure for reducing the power loss in the valve train mechanism, most studies have focused on lightening parts with the object of lightening inertial weight, and on reducing the friction work for sliding parts.

FIG. 3 shows a specific example of the valve train mechanism of an automobile engine. In FIG. 3, 1 is a cylinder head of the engine, 2 is a cam, 3 is a valve lifter, 4 is an adjusting shim, 5 is a suction and exhaust valve, 6 is a valve seat, and 7 is a valve spring. For the valve train mechanism shown in FIG. 3, by driving the valve lifter 3 through the cam 2, the displacement of the cam 2 is conveyed to the suction and exhaust valve 5.

For the aforementioned valve train mechanism, the adjusting shim 4 is placed between the cam 2 and the valve lifter 3, and therefore the adjusting shim 4 slides with the cam 2 and the valve lifter 3. This adjusting shim 4 is used for adjusting the valve clearance, and from the past was usually produced from metal. For this kind of adjusting shim 4 as well, there is a need for lighter weight and improved abrasion resistance to reduce power loss.

As a measures for reducing power loss for the aforementioned valve train mechanism, for example, Japanese patent publication 6-294307 discloses the use of diamond for the preparation of an adjusting shim as a sliding part, or depositing diamond on the base material of the adjusting shim in order to reduce friction work, in other words to reduce the coefficient of friction $\mu$.

However, with this adjusting shim, it is necessary to finish the diamond surface to a smooth mirror surface, and because diamond is a very difficult material to cut, the processing cost becomes very expensive, and since diamond is a high cost material, the overall cost becomes very high. Also, when the base material is a metal, there is a big difference in the modulus of longitudinal elasticity of the metal and the diamond that covers it, so internal stress occurs at the interface of these two materials, leading to the problem of the diamond peeling from the metal base material.

SUMMARY OF THE INVENTION

Taking into consideration these problems with the prior art, an object of the present invention is to provide a diamond-coated sliding part that is light weight, excellent abrasion resistance, and prevents abrasion of the material of the mating member while being effective in reducing the power loss.

To achieve the aforementioned object, the diamond-coated sliding part provided by the present invention is a sliding part comprising a base material made of silicon nitride or sialon having a diamond coating layer on the surface thereof, in which the profile bearing length ratio ($t_p$) at a cutting level of 0.1 $\mu$m specified in Japanese Industrial Standard (JIS) B 0601 is 60% or greater for the sliding surface of the diamond coating layer.

By performing a finishing processing on only a small part of peaks of diamond particles protruding from the surface of the diamond coating layer after the formation of the aforementioned diamond coating layer, or by controlling various conditions during the above film formation, the profile bearing length ratio ($t_p$) is adjusted as noted above, and the diamond coating layer surface is made smooth or having no projecting parts.

DESCRIPTION OF THE PREFERRED EMBODIMENTS

Figure 1:
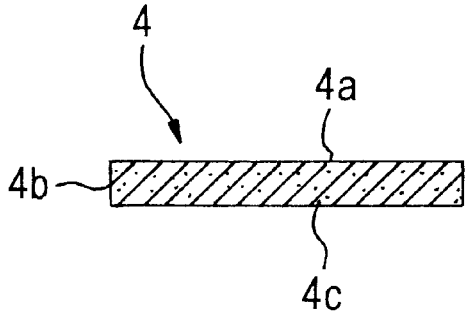
FIG. 1 is a vertical cross section of an adjusting shim.

For the diamond-coated sliding part of the present invention, the base material is made from silicon nitride ($Si_3N_4$) or sialon (Si—Al—O—N). Both silicon nitride and sialon are ceramic materials, and are very light compared to metal while at the same time having a high level of hardness, excellent abrasion resistance and high heat resistance. In particular, for the strength of silicon nitride or sialon used for the base material, it is preferable that the three-point flexural strength ($\sigma 3_b$) be 1000 MPa or greater because this is used as a sliding part.

The diamond coating layer provided on the base material is preferably a gas phase synthetic diamond formed using a known PVD method or CVD method. Of these, with the CVD method, it is possible to decompose raw material gases such as hydrocarbon gas and hydrogen gas and to deposit diamond from the gas phase on the base material, and depending on the decomposition process of the raw material gas, methods such as thermal heating filament method, microwave plasma method, and high frequency plasma method are known.

Also, diamond has a high degree of hardness and has excellent thermal conductivity, so it is well suited as an abrasion resistant sliding coating film. Also, the difference in the thermal expansion coefficient and modulus of longitudinal elasticity between diamond and the base material (i.e., silicon nitride or sialon) is small, so the diamond coating layer does not peel from the base material. It is preferable that the thickness of the diamond coating layer be in the range of 0.5 to 20 $\mu$m. At less than 0.5 $\mu$m, it is not possible to obtain sufficient strength as a diamond, and at greater than 20 $\mu$m, the cost becomes high. However, if there is a benefit that justifies the cost, it is acceptable to form the layer at a thickness greater than 20 $\mu$m.

In one embodiment of the present invention, only a small part of peaks of diamond particles protruding from the surface of the diamond coating layer undergoes a finish processing, in other words, part of the peaks of higher protrusions of the protruding parts is removed to reduce the height of the protrusions, and thereby the surface is made smooth or the protruding parts are eliminated from the surface profile. As a method for this finish processing, it is possible to use a polishing process using a diamond grinding stone, for example, or to use a lapping process using fine free abrasive grains of 10 μm or less.

By using the aforementioned finishing process, regardless of the state of the surface of the diamond coating layer obtained using the gas phase synthesizing method, at the sliding surface, the profile bearing length ratio ($t_p$) is adjusted to be 60% or greater at a cutting level of 0.1 μm.

In another embodiment of the present invention, the surface state of the diamond coating layer formed on the base material can also be adjusted by conditioning the base material surface state or by controlling the film forming conditions using a gas phase synthesizing method or the like. Therefore, for the present invention, by controlling these various conditions, at the sliding surface of the diamond coating layer, the profile bearing length ratio ($t_p$) is adjusted to be 60% or greater at a cutting level of 0.1 μm, and the surface can be smooth or have a surface state with no projecting parts in the surface profile, and in this case, the aforementioned finishing process is not needed.

By making the profile bearing length ratio ($t_p$) be 60% or greater at a cutting level of 0.1 μm in this way, the loss torque is smaller than that of the metal made sliding parts of the prior art, and the loss torque itself is also smaller as the aforementioned profile bearing length ratio increases, so the abrasion loss of the counterpart member is reduced. However, even if the profile bearing length ratio ($t_p$) at a cutting level of 0.1 μm is made 85% or greater, no more reduction in loss torque can be obtained, and the abrasion loss of the counterpart member is almost the same.

For the present invention, "profile bearing length ratio ($t_p$)" as prescribed in JIS B 0601 is the ratio of the sum of cut lengths obtained at the time of cutting the roughness curve within the range of the reference length at a certain cutting levels parallel to the top of profile peak line (profile bearing length) to the reference length and the ratio is expressed in percentage. Measurements of the profile bearing length ratio ($t_p$) was performed in compliance with the aforementioned JIS, and the reference length was 0.25 mm while the evaluation length was 1.25 mm.

In the diamond-coated sliding part of the present invention, the profile bearing length ratio ($t_p$) for a cutting level of 0.1 μm is adjusted by the finishing process or by adjustment of the film forming conditions, and the surface of the diamond coating layer is made smooth or projecting parts of the surface profile are eliminated, so that it is possible to reduce friction loss that occurs with the opposite member and to suppress the power loss. Therefore the sliding part of the present invention is excellent as a sliding part used for a valve train mechanism of an internal combustion engine of an automobile engine or the like. Also, by using silicon nitride or sialon as the base material, it is possible to make this lighter than items made of metal or using metal as the base material, and the difference in the modulus of longitudinal elasticity and thermal expansion coefficient between the base material and diamond is small, so the adhesive force of the diamond coating layer becomes greater.

Following, the present invention will be described specifically using working examples. For each of the following examples, an adjusting shim was used as an example of the sliding part.

EXAMPLE 1

A gas phase synthetic diamond was deposited by a known filament CVD method on each of the base materials made from $Si_3N_4$ sintered bodies having different three-point flexural strengths to produce adjusting shims. The adjusting shims thus obtained as samples all had a diameter of 30 mm and a thickness of 5 mm.

For each adjusting shim provided with a diamond coating layer, as shown in FIG. 1, the contact surface 4*a* of the adjusting shim 4 to be brought into contact with the cam was finished by lapping. At this time, by changing the lapping conditions, the profile bearing length ratio at a cutting level of 0.1 μm (shown as $t_p$ 0.1 in Table 1 below) was adjusted to the values shown in table 1 below for each. 4*b* and 4*c* in FIG. 1 indicate the contact surfaces with the valve lifter.

Figure 4:
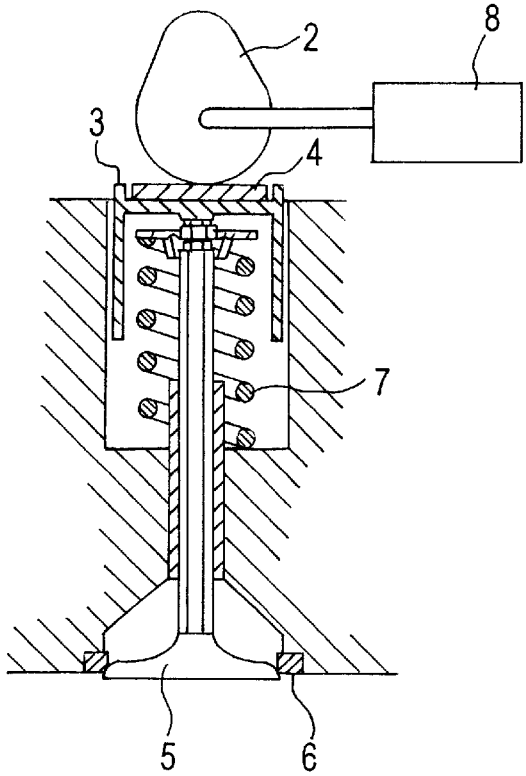
FIG. 4 is a vertical cross section of a motoring device used in the tests in the examples.

Each adjusting shim 4 produced in this manner was installed into a motoring device shown in FIG. 4 in which a direct striking type OHC valve train mechanism was reproduced, the motor power consumption was measured at a fixed revolution rate of a motor 8 (2000 rpm and 4000 rpm converted to engine revolution rate), and power loss was evaluated. The results that were obtained are shown in Table 1 below.

Also, for comparison, for an adjusting shim made from a Cr—Mo steel according to the prior art and an adjusting shim made only from an $Si_3N_4$ sintered body were also tested in the same manner as described above, and the results are shown together in Table 1.

TABLE 1

| Sample | Shim Material | Tp 0.1 (%) | Base Material Strength (MPa) | Diamond Layer Thickness (μm) | Motor Power Consumption 2000 rpm | Motor Power Consumption 4000 rpm |
|---|---|---|---|---|---|---|
| 1A | Coated with diamond | 60 | 1200 | 5.0 | 0.63 | 0.71 |
| 2A | Coated with diamond | 65 | 1150 | 5.0 | 0.54 | 0.59 |
| 3A | Coated with diamond | 75 | 1200 | 15.0 | 0.45 | 0.51 |
| 4A | Coated with diamond | 80 | 1050 | 2.0 | 0.35 | 0.38 |
| 5A | Coated with diamond | 85 | 1300 | 5.0 | 0.25 | 0.32 |
| 6A | Coated with diamond | 90 | 1200 | 1.0 | 0.24 | 0.29 |
| 7A | Coated with diamond | 95 | 1200 | 2.0 | 0.25 | 0.29 |
| 8A* | Coated with diamond | 50 | 1200 | 0.3 | Diamond coating layer peeled | |
| 9A* | Coated with diamond | 55 | 800 | 3.0 | Shim was broken | |
| 10A* | $Si_3N_4$ | 40 | (1200) | — | 1.35 | 1.52 |
| 11A* | Cr—Mo steel | 90 | — | — | 1.17 | 1.30 |

Note: Samples marked by an asterisk * in the table are comparison examples.

As can be seen from the results shown in Table 1 above, with the adjusting shims of samples 1A through 7A provided with the diamond coating layer according to the present invention, it was possible to make a much greater reduction in motor power consumption, of course compared with the adjusting shim made from the $Si_3N_4$ sintered body with poor surface flatness, and also compared with the adjusting shim made from the prior art Cr—Mo steel and having a profile bearing length ratio $t_p$ 0.1 of 90%.

Also, even with an adjusting shim provided with a diamond coating layer on the surface of an $Si_3N_4$ base material, it was-not possible to obtain a reduction in motor power consumption if the aforementioned profile bearing length ratio $t_p$ 0.1 was less than 60%, and in particular with sample 8A in which the thickness of the diamond coating layer was thin, the diamond coating layer peeled off and for sample 9A in which the strength of the $Si_3N_4$ base material was weak, the adjusting shim itself was broken.

EXAMPLE 2

Each sample adjusting shim shown in Table 2 below produced in the same manner as the aforementioned Example 1 was installed into the motoring device of FIG. 4 used for Example 1, and a continuous drive test was performed for 200 hours at a fixed revolution rate (6000 rpm converted to engine revolution rate).

Figure 3:
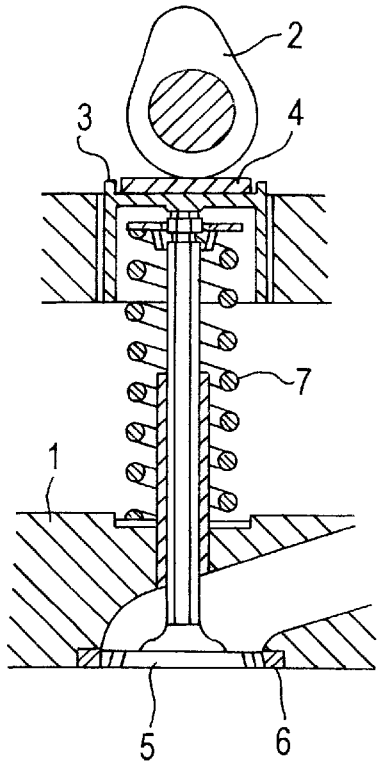
FIG. 3 is a vertical cross section of the valve train mechanism of an automobile engine.

After this continuous drive test, the abrasion loss of a valve lifter 3 sliding with the adjusting shim 4 was evaluated. For the abrasion loss of this valve lifter 3, as shown in FIG. 3, an inner diameter dimension R of the part onto which the adjusting shim was mounted was measured before and after the test, and the abrasion loss of valve lifter 3 was evaluated from the dimensional difference in R. The results that were obtained are shown in table 2.

Also, for comparison, as with Example 1, the same test as described above was also performed on an adjusting shim (sample 11A) made from a conventional Cr—Mo steel and on adjusting shims (surface polished sample 20A and unpolished sample 19A) made only from an $Si_3N_4$ sintered body, and the results are shown together in table 2.

TABLE 2

| Sample | Shim Material | $t_p$ 0.1 (%) | Base Material Strength (MPa) | Diamond Layer Thickness (μm) | Dimensional Difference in R Before and After Test (μm) |
|---|---|---|---|---|---|
| 12A | Coated with diamond | 60 | 1200 | 3.0 | 3.5 |
| 13A | Coated with diamond | 65 | 1250 | 10.0 | 3.2 |
| 14A | Coated with diamond | 75 | 1100 | 1.5 | 2.3 |
| 15A | Coated with diamond | 80 | 1150 | 2.5 | 1.9 |
| 16A | Coated with diamond | 85 | 1100 | 8.0 | 1.4 |
| 17A | Coated with diamond | 90 | 1030 | 2.5 | 1.5 |
| 18A | Coated with diamond | 95 | 1200 | 2.0 | 1.3 |
| 19A* | $Si_3N_4$ | 50 | (1200) | — | 18 |
| 20A* | $Si_3N_4$ (polished) | 60 | (1200) | — | 12 |
| 11A* | Cr—Mo steel | 90 | — | — | 25 |

Note: Samples marked by an asterisk * in the table are comparison examples.

As can be seen from the results shown in Table 2, by using the adjusting shims provided with the diamond coating layer, namely the samples 12A through 18A of the present invention, it was possible to make a huge reduction in abrasion of the valve lifter as a counterpart member, compared to the adjusting shim made from the $Si_3N_4$ sintered body and to the adjusting shim made from the conventional Cr—Mo steel. Also, it can be seen that, by employing the surface-finished diamond coating layer, the greater the aforementioned profile bearing length ratio $t_p$ 0.1, the more it is possible to reduce abrasion of the valve lifter as the counterpart member.

EXAMPLE 3

A gas phase synthetic diamond was deposited by a known filament CVD method on each base material made from $Si_3N_4$ sintered bodies having different three-point flexural strengths to produce adjusting shims. All the sample adjusting shims had a diameter of 30 mm and a thickness of 5 mm.

During the aforementioned gas phase synthesis, film forming conditions were changed for each sample so that, for the contact surface 4*a* of the adjusting shim 4 and the cam, as shown in FIG. 1, the profile bearing length ratio at a cutting level of 0.1 μm (shown as $t_p$ 0.1 in Table 3 below) was adjusted to the values shown in Table 3 below for each. 4*b* and 4*c* in FIG. 1 indicate the contact surfaces to be brought into contact with the valve lifter.

Each adjusting shim 4 produced in this manner was installed into the motoring device shown in FIG. 4 in which a direct striking type OHC valve train mechanism was reproduced, the motor power consumption was measured at a fixed revolution rate by a motor 8 (2000 rpm and 4000 rpm converted to engine revolution rate), and power loss was evaluated. The results that were obtained are shown in table 3 below.

Also, for comparison, tests were conducted also for an adjusting shim made from a Cr—Mo steel of the prior art and an adjusting shim made only from an $Si_3N_4$ sintered body in the same manner as described above, and the results are shown together in Table 3.

TABLE 3

| Sample | Shim Material | Tp 0.1 (%) | Base Material Strength (MPa) | Diamond Layer Thickness (μm) | Motor Power Consumption 2000 rpm | Motor Power Consumption 4000 rpm |
|---|---|---|---|---|---|---|
| 1B | Coated with diamond | 60 | 1200 | 5.0 | 0.71 | 0.81 |
| 2B | Coated with diamond | 65 | 1150 | 5.0 | 0.62 | 0.67 |
| 3B | Coated with diamond | 75 | 1200 | 15.0 | 0.55 | 0.59 |
| 4B | Coated with diamond | 80 | 1059 | 2.0 | 0.47 | 0.50 |
| 5B | Coated with diamond | 85 | 1300 | 5.0 | 0.35 | 0.40 |
| 6B | Coated with diamond | 90 | 1200 | 1.0 | 0.29 | 0.33 |
| 7B | Coated with diamond | 95 | 1200 | 2.0 | 0.27 | 0.31 |
| 8B* | Coated with diamond | 50 | 1200 | 0.3 | Diamond coating layer peeled | |
| 9B* | Coated with | 55 | 800 | 3.0 | Shim was broken | |

TABLE 3-continued

| Sample | Shim Material | Tp 0.1 (%) | Base Material Strength (MPa) | Diamond Layer Thickness (μm) | Motor Power Consumption 2000 rpm | Motor Power Consumption 4000 rpm |
|---|---|---|---|---|---|---|
| 10B* | diamond $Si_3N_4$ | 40 | (1200) | — | 1.35 | 1.52 |
| 11B* | Cr—Mo steel | 90 | — | — | 1.17 | 1.30 |

Note: Samples marked by an asterisk * in the table are comparison examples.

As can be seen from the results shown in Table 3 above, with the adjusting shims of samples 1B through 7B provided with the diamond coating layer according to the present invention, it was possible to make a much greater reduction in motor power consumption, of course compared with the adjusting shim made from the $Si_3N_4$ sintered body with poor surface flatness and also compared with the adjusting shim made from the conventional Cr—Mo steel and having a profile bearing length ratio $t_p$ 0.1 of 90%.

Also, even with an adjusting shim provided with a diamond coating layer on the surface of an $Si_3N_4$ base material, it is not possible to obtain a reduction in motor power consumption if the aforementioned profile bearing length ratio $t_p$ 0.1 is less than 60%, and particularly with sample 8B in which the thickness of the diamond coating layer was thin, the diamond coating layer peeled, and for sample 9B in which the strength of the $Si_3N_4$ base material was weak, the adjusting shim itself was broken.

EXAMPLE 4

Each sample adjusting shim shown in Table 4 below produced in the same manner as the aforementioned Example 3 was incorporated in the motoring device of FIG. 4 used for Example 3, and a continuous drive test was performed for 200 hours at a fixed revolution rate (6000 rpm converted to engine revolution rate).

Figure 2:
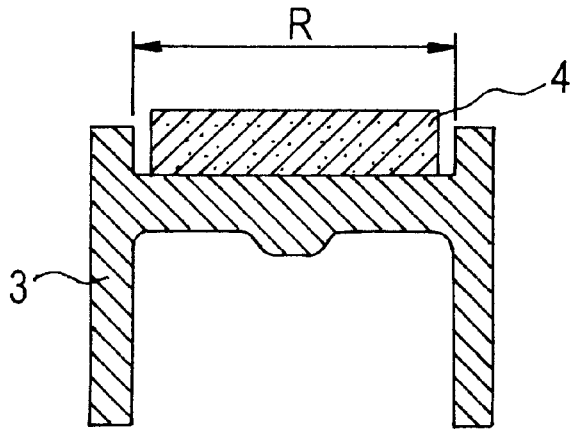
FIG. 2 is a vertical cross section of an adjusting shim installed into a valve lifter.

After this continuous drive test, the abrasion loss of the sliding valve lifter 3 to slide with the adjusting shim 4 was evaluated. For the abrasion loss of this valve lifter 3, as shown in FIG. 2, the inner diameter dimension R of the part onto which the adjusting shim 4 was mounted was measured before and after the test, and the abrasion of valve lifter 3 was evaluated from the dimensional difference in R. The results that were obtained are shown in Table 4.

Also, for comparison, as with Example 3, the same test as described above was also performed on the adjusting shim (sample 11B) made from the conventional Cr—Mo steel and on the adjusting shims (surface polished sample 20B and unpolished sample 19B) made only from the $Si_3N_4$ sintered body, and the results are shown together in Table 4.

TABLE 4

| Sample | Shim Material | $t_p$ 0.1 (%) | Base Material Strength (MPa) | Diamond Layer Thickness (μm) | Dimensional Difference in R Before and After Test (μm) |
|---|---|---|---|---|---|
| 12B | Coated with diamond | 60 | 1200 | 3.0 | 6.7 |
| 13B | Coated with diamond | 65 | 1250 | 10.0 | 6.2 |
| 14B | Coated with diamond | 75 | 1100 | 1.5 | 5.8 |
| 15B | Coated with diamond | 80 | 1150 | 2.5 | 5.1 |
| 16B | Coated with diamond | 85 | 1100 | 8.0 | 4.5 |
| 17B | Coated with diamond | 90 | 1030 | 2.0 | 4.3 |
| 18B | Coated with diamond | 95 | 1200 | 2.0 | 4.2 |
| 19B* | $Si_3N_4$ | 50 | (1200) | — | 18 |
| 20B* | $Si_3N_4$ (polished) | 60 | (1200) | — | 12 |
| 11B* | Cr—Mo steel | 90 | — | — | 25 |

Note: Samples marked by an asterisk * in the table are comparison examples.

As can be seen from the results shown in Table 4, by using the adjusting shims provided with the diamond coating layer for samples 12B through 18B of the present invention, it is possible to make a huge reduction in abrasion of the valve lifter as a counterpart member compared to the adjusting shims made from the $Si_3N_4$ sintered body and to the adjusting shim made from the prior art Cr—Mo steel. Also, it can be seen that, the greater the aforementioned profile bearing length ratio $t_p$ 0.1 is, the more it is possible to reduce abrasion of the valve lifter as the opposite member.

According to the present invention, it is possible to provide an excellent highly reliable diamond-coated sliding part that is light, has excellent abrasion resistance, prevents abrasion of the counterpart member with which the sliding part slides, and can greatly reduce power loss. By using this diamond-coated sliding part, it is possible to improve the abrasion resistance and the friction loss that occurs between the diamond coating layer and the opposite member. It is also possible to reduce power loss as a valve train mechanism of an internal combustion engine, and to improve fuel consumption and durability remarkably.

What is claimed is:

1. A diamond-coated sliding part comprising a base material made of silicon nitride or sialon having a diamond coating layer on a surface thereof, wherein a profile bearing length ratio ($t_p$) at a cutting level of 0.1 μm specified in JIS B 0601 is 60% or greater for the sliding surface of the diamond coating layer.

2. The diamond-coated sliding part of claim 1 wherein only a part of peaks of diamond particles protruding from the surface of the diamond coating layer has undergone a finishing processing to provide the profile bearing length ratio.

3. The diamond-coated sliding part of claim 1 wherein the surface of the diamond coating layer has not undergone a finishing processing.

4. The diamond-coated sliding part of claim 1 wherein the base material of silicon nitride or sialon has a three-point flexural strength of 1000 MPa or greater.

5. The diamond-coated sliding part of claim 1 wherein the diamond coating layer is a gas phase synthetic diamond.

6. The diamond-coated sliding part of claim 1 wherein the thickness of the diamond coating layer is 0.5 to 20 $\mu$m.

7. The diamond-coated sliding part of claim 1 wherein the sliding part is used for the valve train mechanism of an internal combustion engine.

* * * * *